United States Patent [19]

Nesje

[11] 4,219,006

[45] Aug. 26, 1980

[54] STOVE-HEARTH COMBINATIONS

[76] Inventor: Arnfinn Nesje, Simon Leinums veg 17, N-7080 Heimdal, Norway

[21] Appl. No.: 881,041

[22] Filed: Feb. 24, 1978

[51] Int. Cl.[2] ..... F24M 7/00

[52] U.S. Cl. ..... 126/192; 16/144; 49/257; 49/414

[58] Field of Search ..... 126/190, 191, 194, 197, 126/202, 121, 123, 126, 138, 140, 114, 37 A, 37 B, 39 B, 225, 139, 4, 65, 66, 192; 49/407, 414, 418, 257, 254, 258; 220/331, 346, 347; 74/527; 16/143, 144; 1/147, 179

[56] References Cited

U.S. PATENT DOCUMENTS

| | | | |
|---|---|---|---|
| 576,775 | 2/1897 | Cohen | 126/190 |
| 1,525,002 | 2/1925 | Sembower | 49/414 X |
| 1,753,673 | 4/1930 | Thompson | 126/190 X |
| 2,207,046 | 7/1940 | Anderson | 126/194 X |
| 2,337,332 | 12/1943 | Lange | 126/190 X |
| 2,669,499 | 2/1954 | Vanderplank | 49/257 X |
| 2,925,081 | 2/1960 | Shooter | 126/190 |
| 3,048,899 | 8/1962 | Vincent | 16/147 X |
| 3,231,007 | 1/1966 | Kerr | 16/87.4 R X |
| 3,409,004 | 11/1968 | Rehberg | 126/190 |
| 3,466,803 | 9/1969 | Packett | 49/414 X |
| 3,543,603 | 12/1970 | Gley | 74/527 |
| 3,713,664 | 1/1973 | Smolka et al. | 74/527 X |
| 3,768,204 | 10/1973 | Andberg et al. | 16/144 X |
| 4,056,091 | 11/1977 | Moncrieff-Yeates | 126/131 X |
| 4,058,932 | 11/1977 | Peterson et al. | 49/257 X |
| 4,141,336 | 2/1979 | Fitch | 126/126 X |

FOREIGN PATENT DOCUMENTS

| | | | |
|---|---|---|---|
| 670776 | 9/1963 | Canada | 126/194 |
| 875385 | 7/1949 | Fed. Rep. of Germany | 126/190 |
| 864816 | 4/1961 | United Kingdom | 126/190 |

*Primary Examiner*—Samuel Scott
*Assistant Examiner*—Randall L. Green

[57] ABSTRACT

Stove-hearth combinations which comprise a combustion chamber having a pair of side walls supported on a base in opposing relation and joined by a rear wall. A cover or hood defines with the base and front edges of the side walls an opening to the chamber. Two doors are each hingedly associated with upper and lower pivot pins which when the door is in a closed position are disposed adjacent but outside a respective side wall front edge. Along upper and lower side edges of each side wall are formed parallel grooves adapted to be engaged slidably by the upper and lower pivot pins. As the door is opened from a stove to a hearth position the pivot pins are displaced along the grooves causing the door to be led gradually into a position along the outer side of its side wall.

2 Claims, 3 Drawing Figures

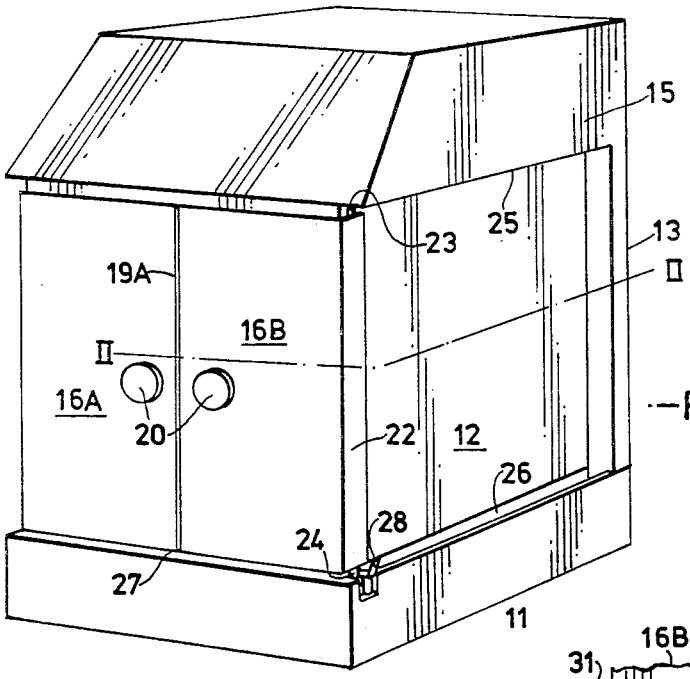
-FIG.1-
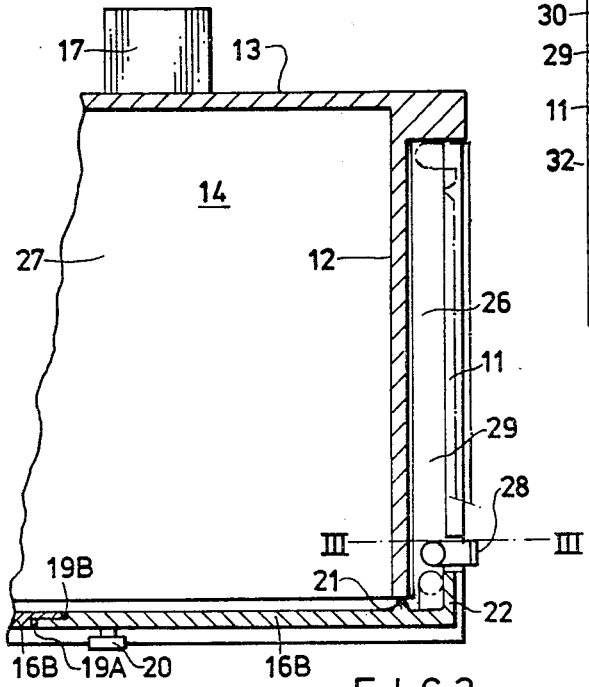
-FIG.2-
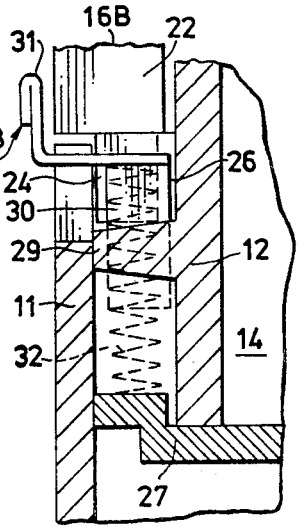
-FIG.3-

STOVE-HEARTH COMBINATIONS

BACKGROUND OF INVENTION

1. Field of Invention

This invention relates to stove-hearth combinations.

2. Description of the Prior Art

A combined stove and open hearth is known in which a wall portion or door can be led downwards from the stove opening and pushed in below the combustion chamber thereof. Such a solution requires a complicated conveyance of the door and precludes the use of the space below the combustion chamber for other purposes, for example, for an oil burner. A fireplace is also known in which the doors can be pushed into the space between the outer wall of the fireplace and a wall which forms the combustion chamber. This provides a complicated and material-demanding design and besides requires a greater external dimension, or provides less combustion chamber for a predetermined outer volume.

SUMMARY OF THE INVENTION

A main object of the present invention is, therefore, to provide a combined stove and open hearth which can be used in various connections in which the space below the combustion chamber can be freely disposed of and in which the space consumption for guiding the doors to the side is the least possible.

According to the present invention a stove-hearth combination comprises a combustion chamber having a base, a rear wall, a pair of side walls supported on said base in opposing relation and joined by said rear wall, a cover defining with said base and front edges of said side walls an opening to said chamber and two doors each hingedly associated with upper and lower pivot means which when the door is in a closed position are disposed adjacent but outside a respective side wall front edge, said side walls each being formed along upper and lower side edges thereof with corresponding upper and lower parallel grooves adapted to be engaged slidably by the upper and lower pivot means which as the door is opened on passage from a stove-forming to a hearth-forming position are displaced along said parallel grooves causing the door to be led gradually into a position along the outer side of its side wall and the length of the grooves being substantially equal to the breadth of their respective door.

Desirably, at least the lower of the parallel grooves contains a stop adapted to be releasably positioned immediately behind the lower pivot means enabling the latter to be arrested facing the foremost portion of the lower side edge of the side wall when the door is closed.

Another desirable feature is that at least one of the grooves for each door is undercut for reception of a correspondingly fashioned pivot means.

The solution according to the invention makes it possible to guide the doors which can be opened to the side away from the hearth opening into a position which is not otherwise used. It is especially practical to arrange the guide grooves at the outer side of the side walls. In addition to this providing technical fabrication advantages. contamination of the grooves with combustion residues is avoided and, at the same time, there is the possibility of varying the external decor.

The stop for arresting at least the one pivot means for each door in its foremost position prevents the doors on unintentional and/or uncontrolled outward pivoting from being led unevenly backwards in the grooves so that the one or the other falls out. Alternatively, the grooves can be undercut so as to form an engagement with, for example, corresponding heads on pivot pins. In this case, it is necessary either to design the pivot pins as separate parts which are fastened on the doors or to allow the grooves to lie between parts which are guided together during assembly.

BRIEF DESCRIPTION OF THE DRAWINGS

In order that the invention can be more clearly understood, a convenient embodiment thereof will now be described, by way of example, with reference to the accompanying drawings in which:

FIG. 1 is a perspective view of a combined stove and open hearth,

FIG. 2 is a section on the line II—II of FIG. 1, and

FIG. 3 is a vertical section, on an enlarged scale, through a portion of the groove region at the under edge of the side wall.

DESCRIPTION OF CONVENIENT EMBODIMENT

Referring to FIG. 1, a combined stove and open hearth comprises a base 11 in the form of a rectangular plate frame, preferably made of cast iron. Above the base 11 there are positioned two side walls 12 opposite each other, which each terminate in a back wall 13 at a respective rear edge. The side walls 12 and the back wall 13 define sideways a combustion chamber 14 which is covered upwardly by a hood 15 which is composed of cast iron parts, and forwardly by two cooperating doors 16A,16B which will be described further below. In the combustion chamber 14, there are present various baffle plates for the combustion gas which are not shown and a base plate 27. On the back wall 13, there is arranged a smoke tube 17 which is designed for coupling to a pipe. The smoke tube 17 could, if desired, be placed on the upper side of the hood 15.

The base 11 can be utilised for placing the combined stove and open hearth directly on a floor, on a brick foundation or on a lower portion which is provided with an oil burner, drawer for wood or the like. Instead of the base 11, there could also be utilised legs for maintaining the stove-hearth at a suitable height above the ground. In principle, the combined stove/hearth can also be bricked into a niche or another surround so that only the doors 16A,16B and the front of the base 11 and the hood are visible.

The design of the doors 16A,16B are shown further in FIG. 2. Each door has a flat, plate-shaped main portion 18 which, if desired, can be provided with decorations or decor on the outer side as well as a ventilation flap (not shown). The doors 16A,16B are rectangular and each is adapted for its respective portion of the opening between the front edges of the side walls 12, they being provided with corresponding rebates 19A,19B at their contacting edges, and each with its handle 20.

At the side edge, each door is provided with a rib 21 which in the closed position of the door projects inwardly up to the front edge of the side wall 12, and outside the rib 21 an L-shaped portion 22 faces in the same direction. The L-shaped portion supports at the upper and lower edges, upwardly and downwardly projecting pivot pins 23,24 respectively. The upper pivot pin 23 engages in a slot or a groove 25 which is arranged at the upper edge of the adjacent side wall 12 at the transition to the hood 15. Similarly, the pivot pin 24 engages in an upwardly directed groove 26 which extends along the side wall 12 parallel to the groove 25, for example with the design shown in FIG. 3. The grooves 25,26 and the pivot pins 23,24 are so dimensioned relative to each other that the pivot pins can be displaced without particular play along the grooves. The associated door 16A or 16B can hence be led into position on the outer side of the corresponding adjacent side wall 12.

In order to prevent the pivot pins 23,24 from being moved independently of each other forwards or backwards in the grooves 25 or 26, the grooves can be undercut and the pivot pins adapted to this design so that they are not drawn out. In this case, it will be necessary to either design the pivot pins 23,24 as separate parts which are detachably fastened to the respective doors 16A,16B, or to allow the grooves 25 and 26 to be formed by pairs of side parts which can be joined together around the respective pivot pins on assembly of the combined stove-hearth.

Alternatively, in at least the lower groove 26, there can be positioned a releasable stop 28 for arresting the pivot pin 24 in its foremost position. When the doors are to be pushed into place on the outside of their respective side walls 12, it will then be necessary to release the stop. This will require a conscious handling on the part of the user which normally ensures the vigilance which is needed in order to guide the doors surely into position without the risk of uneven guidance of the pivot pins and falling out. In order to render use still more reliable, there can be arranged a similar stop at least at the rear edge of the upper groove 25.

FIG. 3 shows how the bottom of the groove 26 can be formed by a rib 29 which projects outwardly from the side wall 12 at the under edge of the latter. The rib 29 forms, at the same time, an abutment for the side of the base 11 which projects upwards past the rib so that it forms a boundary for the groove 26 on the side which faces away from the side wall 12. At the front end of the groove 26, viewed in the direction of the hearth opening, there is placed at a distance from the front edge which is equal to the diameter of the pivot pin 24, a stop 28 having a cylindrical main portion 30 which can slide in a vertical direction in an opening in the rib 29, it being pre-biased by a spring 32 towards the upper stop position shown. The stop 28 comprises besides a handle 31 which projects out from the upper edge of the main portion 30 through an outlet in the edge of the base 11. With the handle 31, the stop 28 can thus be moved down and out of the stop position so that the door 16A can be moved rearwardly or taken away. By this design of the grooves 26 and the stop 28, it is possible as an alternative to remove the doors 16A,16B when the stove is to be used as an open hearth.

I claim:

1. A self-contained, dual purpose stove-hearth combination which comprises a combustion chamber having a base, a rear wall, a pair of side walls supported on said base in opposing relation and joined by said rear wall, a cover defining with said base and front edges of said side walls an opening to said chamber and two doors each hingedly associated with upper and lower pivot means which when the door is in a closed position are disposed adjacent but outside a respective side wall front edge, said side walls each being formed along upper and lower side edges thereof with corresponding upper and lower parallel grooves adapted to be engaged slidably by said upper and lower pivot means which as the door is opened on passage from a stove-forming to a hearth-forming position are displaced along said parallel grooves causing the door to be led gradually along the outer side of its respective side wall to occupy a recess for storage of said door defined by said side wall, said base, said rear wall and said cover with its external door face remaining exposed to view and the length of the grooves being substantially equal to the breadth of their respective door, and wherein at least the lower of the parallel grooves contains a spring-loaded stop positioned when the door is closed immediately behind the lower pivot means enabling the latter to be arrested facing the foremost portion of the lower side edge of the side wall, said stop being manually displaceable against the force of its spring-loading to permit the displacement of the door into its recess-occupying position and then releasable into its former active stop position.

2. The combination of claim 1, wherein when the door is in its recess-occupying position its external face projects outside said recess in a direction laterally of said side wall.

* * * * *